US005165501A

United States Patent [19]

Donahey

[11] Patent Number: 5,165,501

[45] Date of Patent: Nov. 24, 1992

[54] LADDER SUPPORT ATTACHMENT

[76] Inventor: Howard E. Donahey, 41 Victory Way, Indianola, Pa. 15051

[21] Appl. No.: 735,927

[22] Filed: Jul. 25, 1991

[51] Int. Cl.[5] ..... E06C 7/48

[52] U.S. Cl. ..... 182/214; 182/107

[58] Field of Search ..... 182/214, 107, 108, 121, 182/116, 45; 248/238, 237

[56] References Cited

U.S. PATENT DOCUMENTS

| | | | |
|---|---|---|---|
| 799,782 | 9/1905 | Ellinger | 182/214 |
| 822,658 | 6/1906 | Emberson | 248/237 |
| 1,004,284 | 9/1911 | Lehmann | 182/214 |
| 1,502,490 | 7/1924 | Tack | 182/214 |
| 1,710,026 | 4/1929 | McCormick | 182/121 |
| 2,541,343 | 2/1951 | Dakin | 248/238 |
| 2,680,554 | 6/1954 | Dakin | 248/238 |
| 2,881,028 | 4/1959 | Baird | 182/116 |
| 3,459,277 | 8/1969 | Frederick | 182/214 |
| 4,311,207 | 1/1982 | Lurry | 182/214 |
| 4,331,217 | 5/1982 | Stecklow | 182/214 |

FOREIGN PATENT DOCUMENTS

| | | | |
|---|---|---|---|
| 612448 | 4/1935 | Fed. Rep. of Germany | 182/45 |
| 1260476 | 1/1972 | United Kingdom | 182/214 |
| 2099060 | 12/1982 | United Kingdom | 182/214 |

*Primary Examiner*—Reinaldo P. Machado

[57] ABSTRACT

A multiple use ladder support attachment (M.U.L.-S.A.), for hollow rung ladders, designed to pivot and lock a pair of arms (with a support plate across one end) so as to offset and support a ladder top from a roof of any slope (pitch) or to pivot the support plate upward and support the ladder top a selectable distance from a vertical wall or to further pivot upward and place the support plate between the ladders rail tops and any fragile siding to protect the siding from damage.

A pair of adjustable length pivotal upper arms connected to a pair of adjustable length pivotal lower arms. The upper arms control the distance from ladder to support plate while the lower arms control the angle of the upper arms (and support plate). The pivotal action allows a simple change from one support position to another.

A second configuration uses an optional support plate to support the ladder top from the peak of a roof.

In a third configuration, the M.U.L.S.A. is attached to the bottom of a ladder to significantly improve base stability.

23 Claims, 13 Drawing Sheets

FIG. 8A
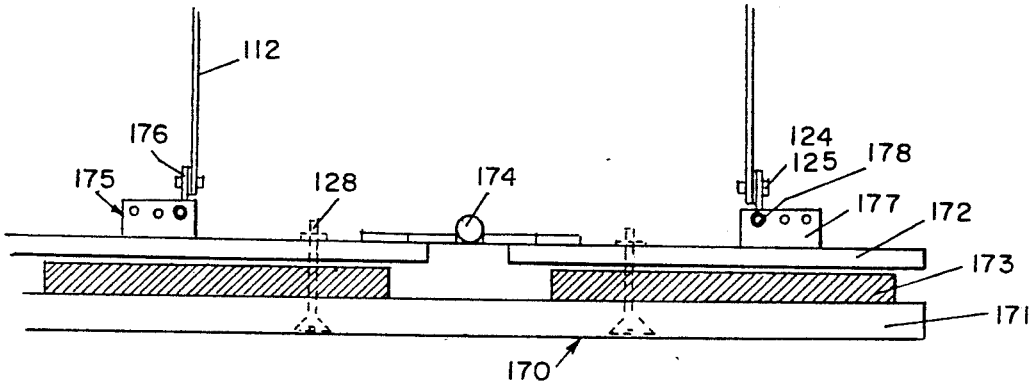
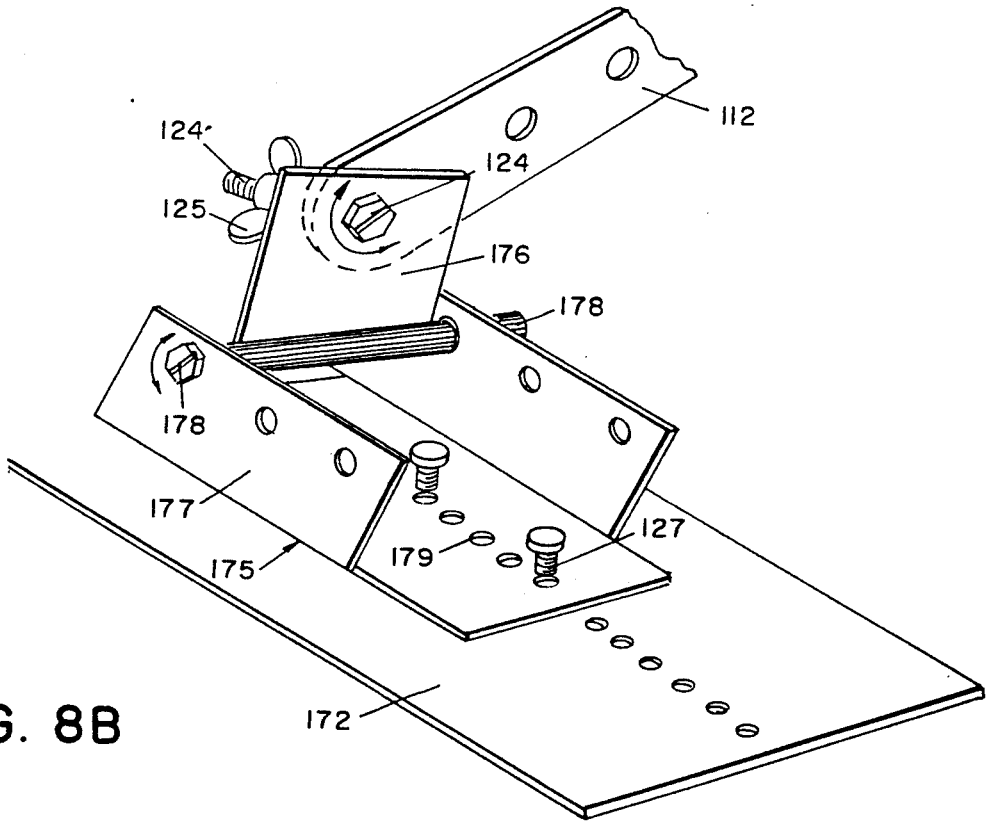
FIG. 8B

15

100
16
14
190
180
112
174
170
RP
125
124
124
178
176
178
175
177
172
173
R

LADDER SUPPORT ATTACHMENT

TECHNICAL FIELD

This invention relates to a multiple use ladder support attachment.

BACKGROUND OF THE INVENTION

The following patents illustrate previous efforts concerning ladder support attachments: U.S. Pat. Nos. 1,004,284, 1,502,490, 1,710,026, 2,541,343, 2,680,554, 2,881,028, 3,459,277 and 4,331,217.

OBJECTS OF THE INVENTION

1. A primary object of this invention is to provide an attachment to hollow rung ladders which will use the roof of a house as a base of support to position the ladder top over and away from gutters and eaves of a building.

2. Another object is to provide a ladder attachment as in object 1 which will use a roof of any slope (pitch) as a base for support.

3. Another object is to position the attachment on a roof at a right angle to the roof for maximum support.

4. Another object is to use a pivoting support mechanism to quickly change from one roof slope support to another.

5. A further object is to provide a quick locking and unlocking system.

6. As in object 4 it will also pivot to support from a vertical wall.

7. As in object 4 it will also pivot to place a buffer (support plate) between the ladder top and fragile siding.

8. As in object 4 it can be easily changed to support from any slope roof, a vertical wall, or be a buffer for the top of the ladder 9. Another object is to allow the device to remain attached to a ladder and use the ladder essentially as a regular ladder.

10. An additional object is to use a different (optional) support plate assembly to support the ladder from the peak of a house at the gable ends.

11. Another object is to provide for attachment of support plate pads of various sizes and shapes.

12. Another object is to provide a support attachment to fit ladders of different widths.

13. Still another object is to maintain a proper ladder angle to ground while supporting in all positions.

14. A further object is to provide a selectable length from the ladder to the support plate.

15. Another object is to easily change the angle of support from the ladder to the support plate.

16. An additional object is to provide a ladder top support structure useful for holding to when entering or exiting a roof.

17. Another object is to provide a sturdy, lightweight, rigid attachment which is easy to assemble and use.

18. An additional object is to attach the device to the bottom of a ladder to greatly improve base stability.

DISCLOSURE OF THE INVENTION

In a primary configuration, the ladder support attachment of the invention uses the roof of a house as a support base to hold a ladder top over and away from a gutter and eaves. The attachment supports and stabilizes the top of the ladder from a roof of any slope (from a flat roof to a vertical wall) while maintaining a proper ladder angle to ground. The attachment is designed to pivot and lock pairs of arms (holding a support plate assembly) about parallel axes which permits a quick operational change from one roof slope to another.

The attachment can further be pivoted upward about these axes and locked to support the ladder top, offset a selectable distance from a vertical wall, or it can be pivoted further upward and locked in place between the ladder rail tops and fragile siding to provide a buffer plate to protect the siding from damage caused by the ladder tops, plus providing additional frictional contact with a wall surface. In this position the ladder can be used essentially as a regular ladder. Alternatively, the attached ladder support attachment can be quickly pivoted to any support position described.

In another configuration the support plate is replaced with an optional support plate assembly which will allow the top of a ladder to be supported offset and away from the peak of a roof at the gable ends of a house.

In another configuration, the multiple use ladder support attachment (M.U.L.S.A.) is attached to the bottom rungs of a ladder with the support plate resting squarely on the ground providing a substantial increase in base stability.

Construction-wise, the M.U.L.S.A. ladder attachment comprises basically a pivoting support plate attached to a pair of adjustable length upper arms. These arms each can pivot at one end about an upper rung. The upper arms are pivotally joined to a pair of adjustable length offset lower arms. These lower arms can pivot at one end about a lower rung.

The upper arms are attached to each end of an adjustable length threaded rod which has been placed inside an upper hollow rung and centered within by rung spacers at each end and secured in place by appropriate means such as wingnuts. The two lower arms are attached in like manner to the next lower rung. Both sets of arms contain locking devices for connecting parts at selected positions. The distance from the ladder to the support plate is controlled by the upper arm length. The angle of the upper arms is controlled by the lower arm length.

Materials of construction may be aluminum or other metals, plastics, wood or any suitable lightweight material. The support plate assembly can accommodate various sizes and shapes of support plate pads.

BRIEF DESCRIPTION OF THE DRAWINGS

FIG. 8A is a front view of the optional combination support plate assembly, showing its connection to the rest of the M.U.L.S.A.

FIG. 8B is an enlarged perspective view of the dual swivel bracket assembly, which is a portion of FIG. 8A.

MODES OF CARRYING OUT THE INVENTION

Figure 1:
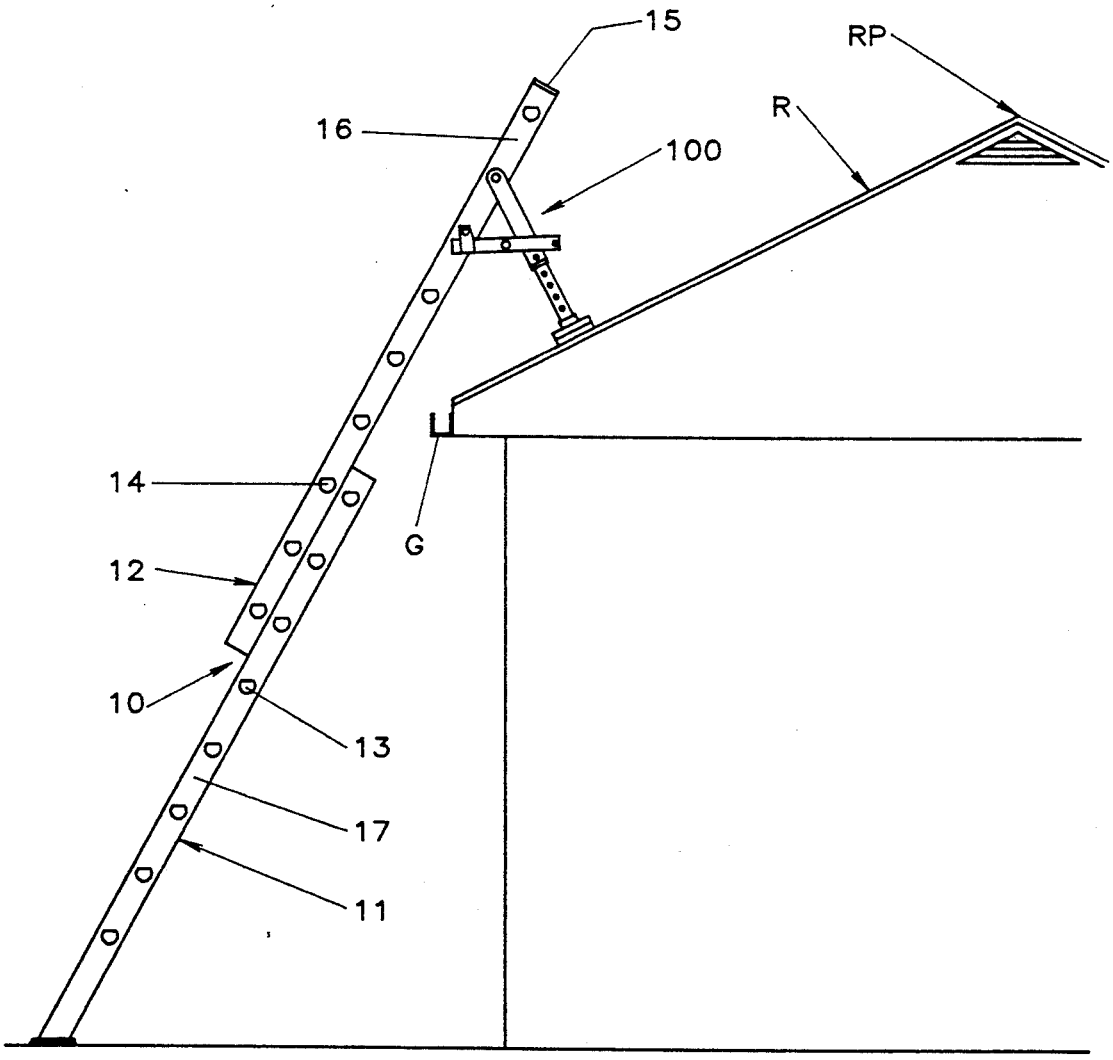
FIG. 1 shows a side elevation of the multiple use ladder support attachment (M.U.L.S.A.) supporting the top of an extension ladder over and away from a gutter and eaves by using the roof as a support base.
Figure 2:
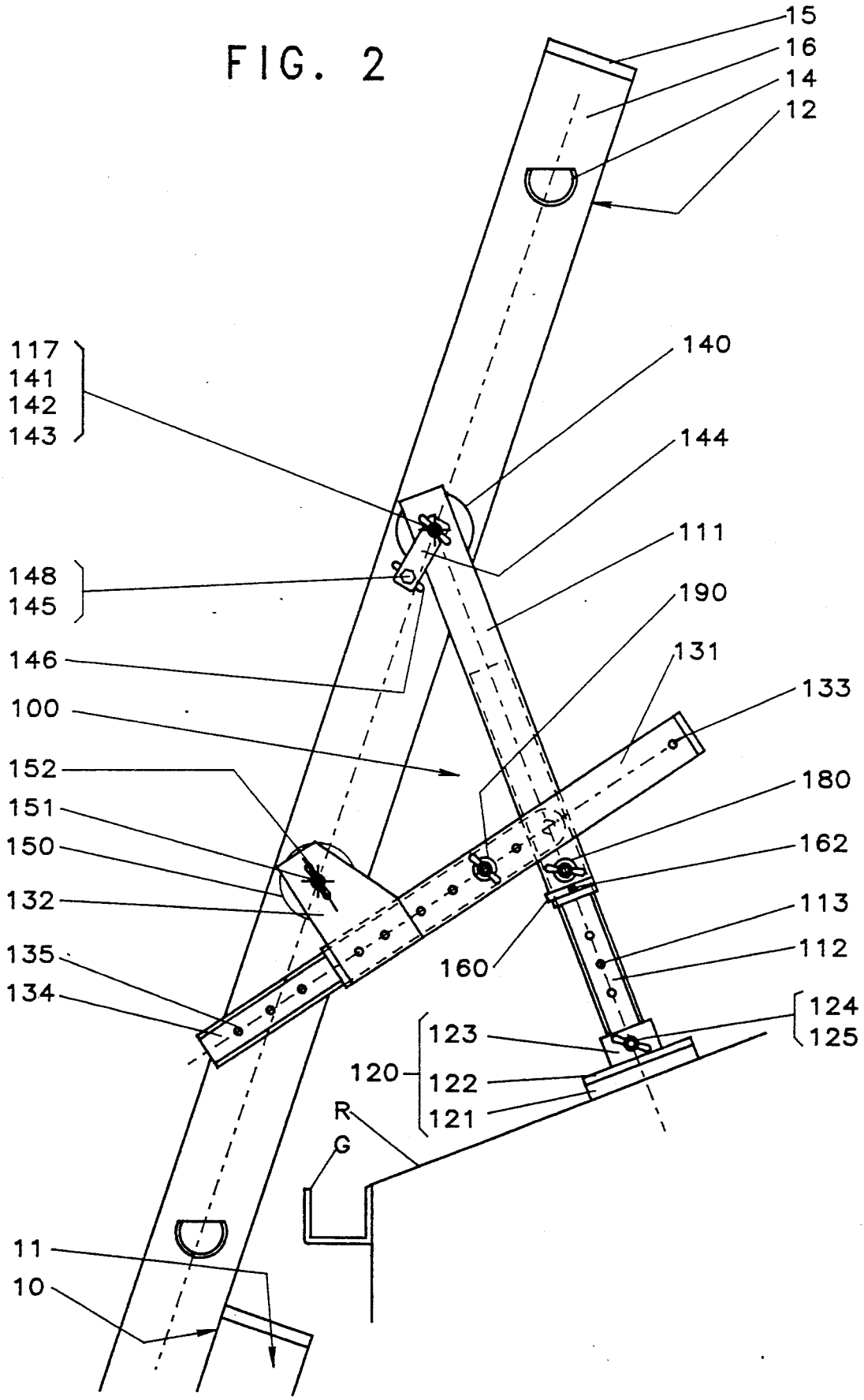
FIG. 2 is an enlarged side view of the top section of FIG. 1 detailing the M.U.L.S.A. parts.

Referring now specifically to FIGS. 1 and 2 of the drawings, the basic structure of the multiple use ladder support attachment (M.U.L.S.A.) described in this invention is designated by the numeral 100. FIGS. 1 and 2 show the M.U.L.S.A. 100 attached to a pair of upper rungs 14 of a hollow rung extension ladder 10 comprising a base section 11 and an upper moveable fly section 12 with a plurality of hollow rungs 14 attached between the rails 16. The M.U.L.S.A. 100 is supporting the top of the ladder 10 offset from a roof r and a gutter g.

Figure 6:
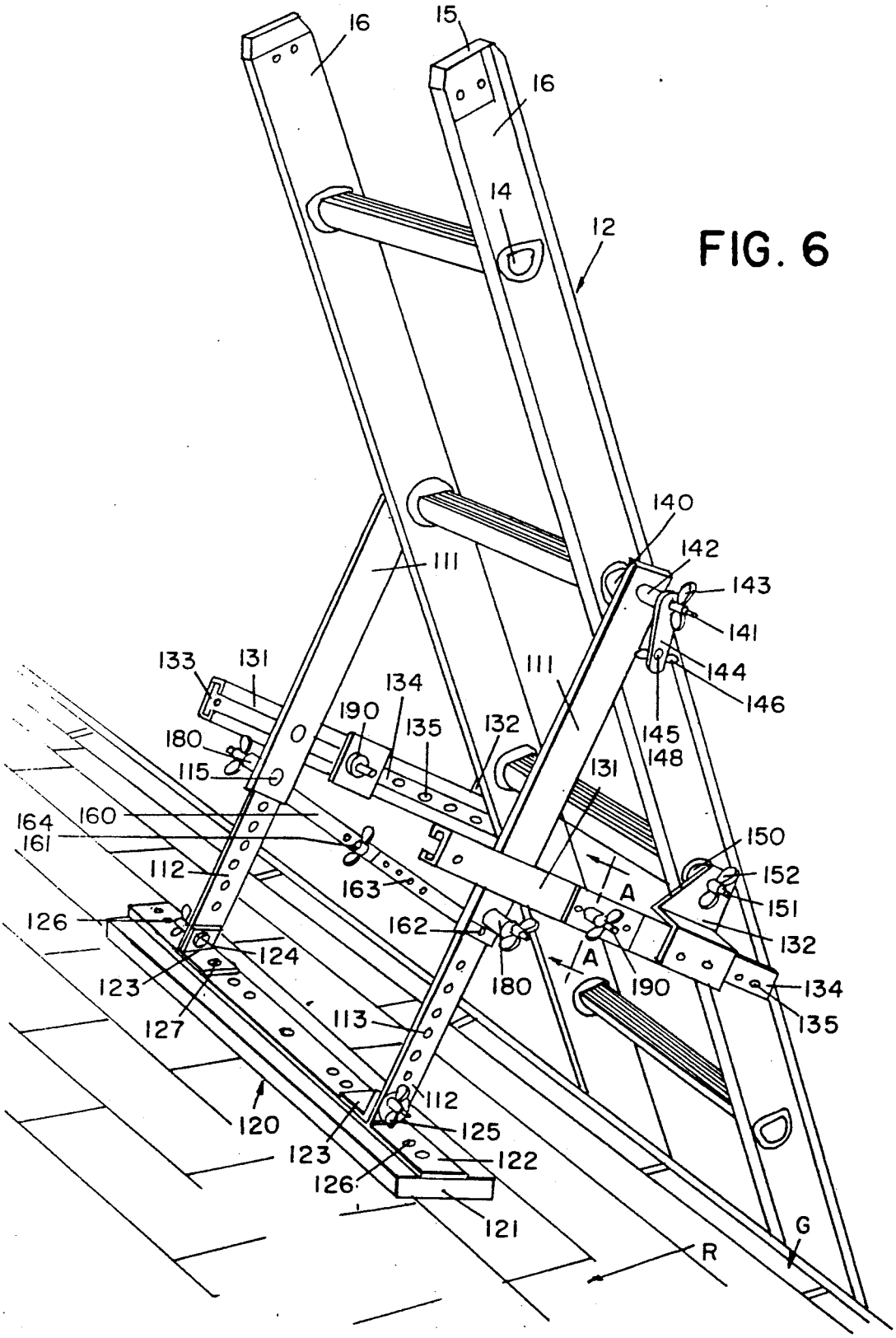
FIG. 6 is a perspective view of the M.U.L.S.A. supporting a ladder top above and away from a gutter using the roof as a support base.

Referring now to FIGS. 2, 6, and particularly to 12 and 12*a*, the attachment of the invention includes a pair of upper arm spokes 111 in the form of tubes of rectangular cross section connected at one end to an adjustable length threaded rod 141. Rod 141 sits inside an upper hollow rung 14 and is centered within by a spacer/collar 140 at each end of the rung. In addition to its centering function, spacer/collar 140 maintains each spoke 111 spaced from its neighboring rail 16, so that spoke 111 can pivot on the axis of rod 141 without experiencing interference from rail 16. The threaded rod 141 extends thru apertures 117 of the upper arm spoke 111, also thru a clearance spacer 142 and storage bracket 144 (used for storage and transporting) and is secured in place with a wingnut 143 or other such means. This rigidly secures the upper arm spokes 111 to the ladder rails 16.

Figure 12:
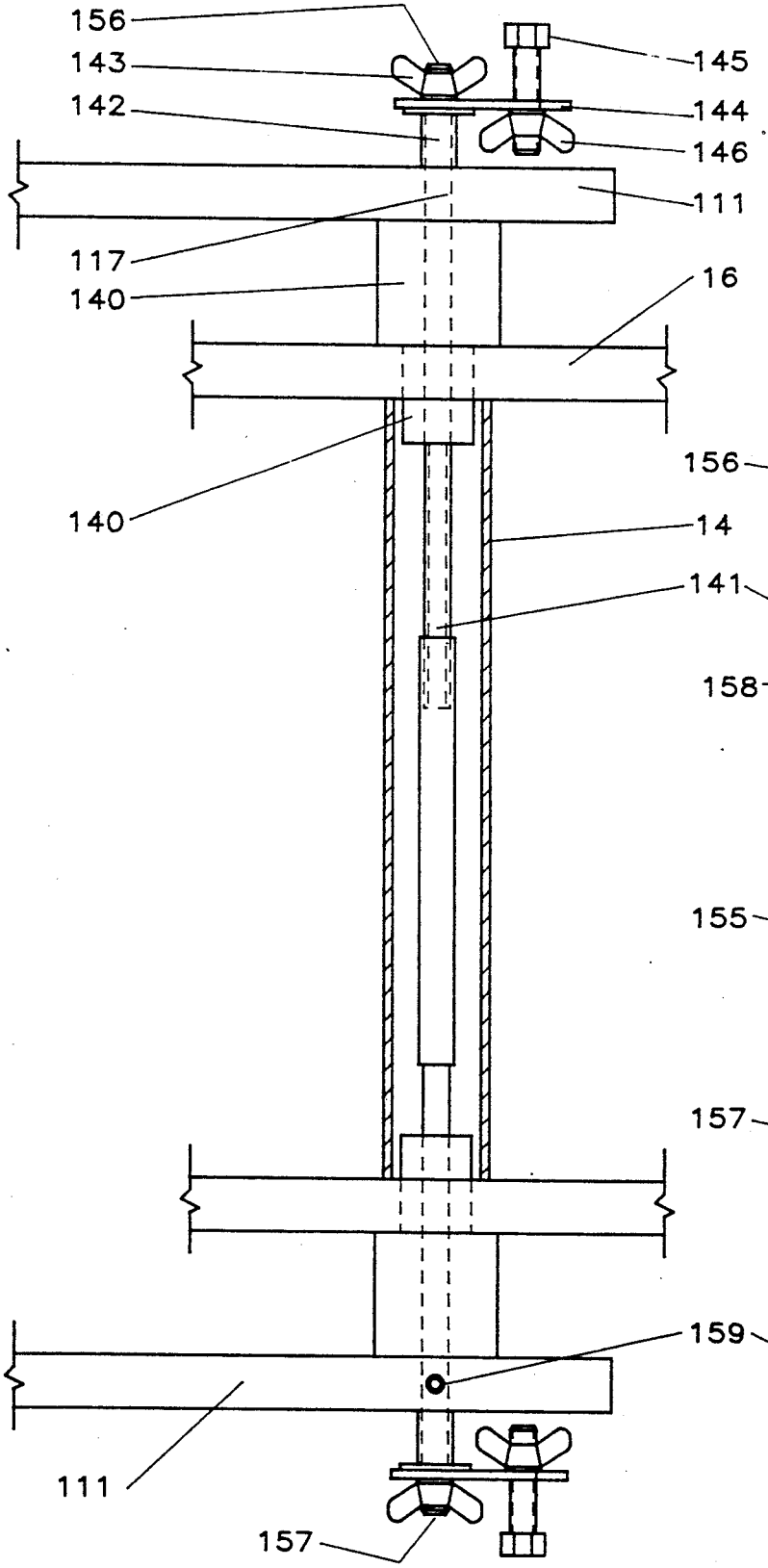
FIG. 12 is a front view of the upper arms, rung spacers, clearance spacers, storage brackets and hardware attached to an adjustable length threaded rod inside an upper rung.
Figure 12A:
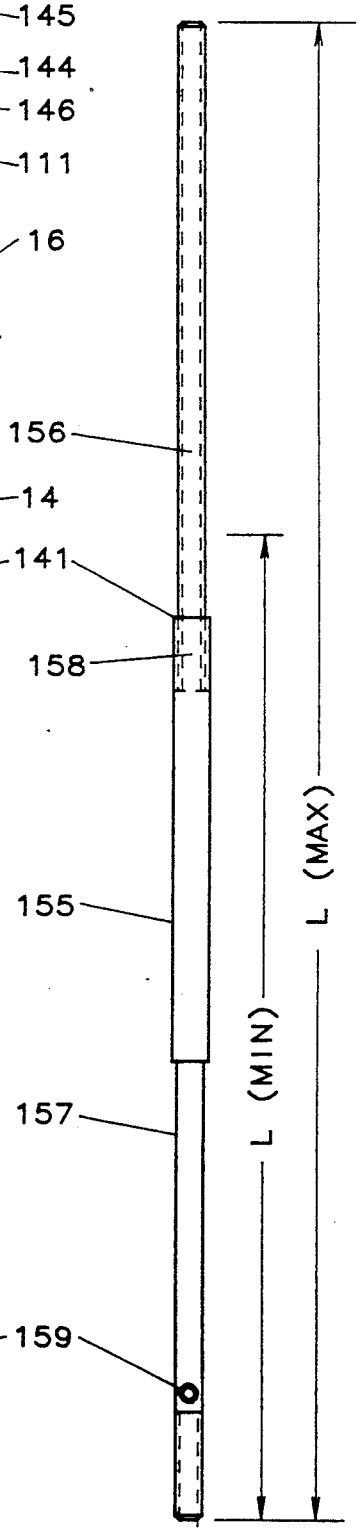
FIG. 12A is a detail of FIG. 12 showing the adjustable length threaded rod.

The adjustable length threaded rod 141 (FIG. 12*a*) consists of a hollow tube 155 with machine threads 158 at one end and a threaded stud 157 affixed to the other end. One end of a threaded rod 156 is screwed thru threads 158 and into the hollow tube 155. The overall length l of the rod 141 is determined by how far into the tube 155 the threaded rod 156 is screwed. This feature is used to attach the M.U.L.S.A. 100 to ladders of different widths, as well as providing other advantages which are discussed in detail below.

As shown in FIG. 6, a variable length cross brace 160 with locking arrangement 161 provides stability to the outer ends of the upper arm spokes 111. The two part brace 160 is joined together at the center by aligning appropriate apertures 163 contained on each part and inserting a bolt 161 and wingnut 164. The outer ends of the brace 160 turn at right angles to lie flat against the outside surfaces of the ends of the upper arm spokes 111 where they are attached using rivet 162 or other means.

Figure 3:
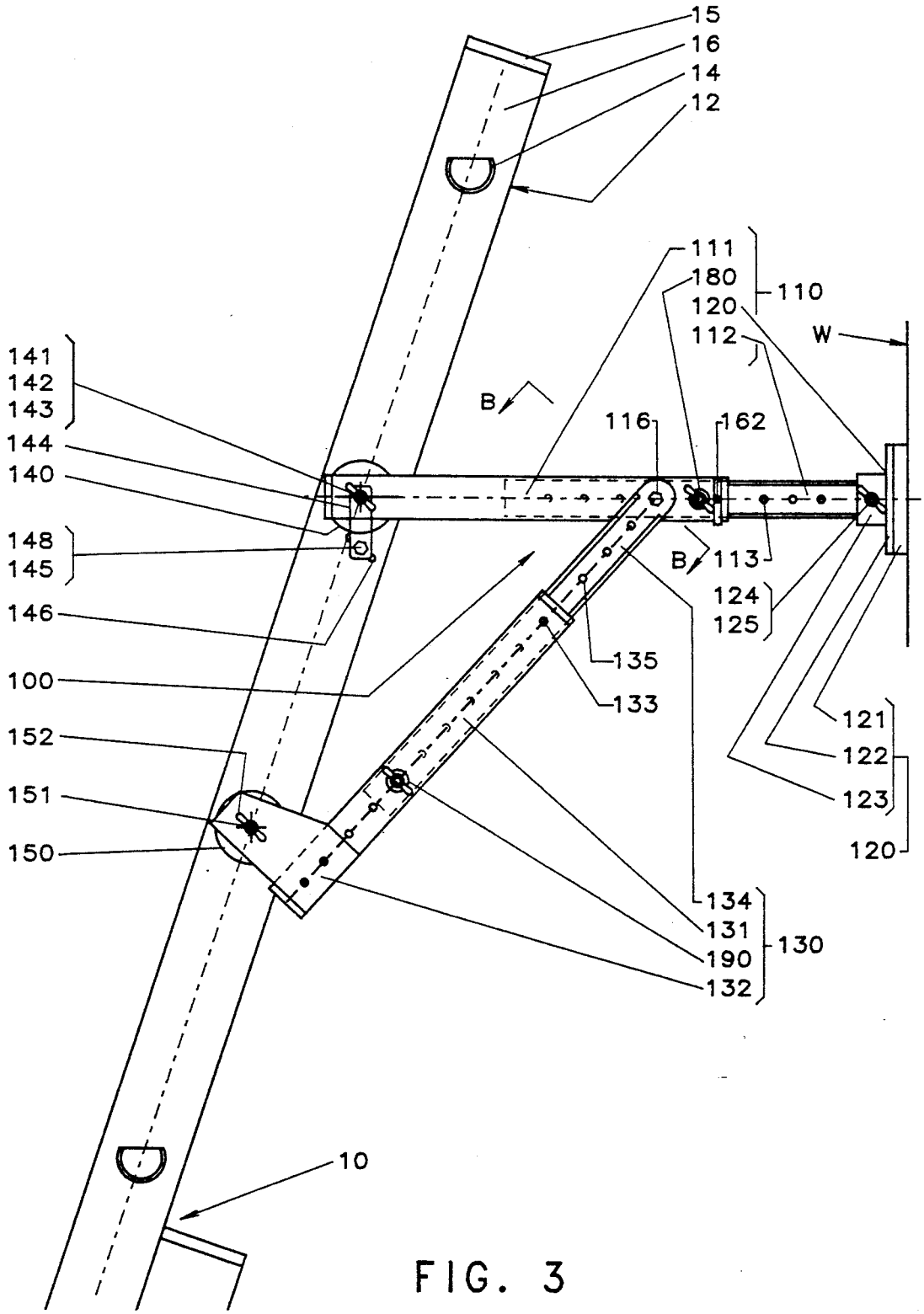
FIG. 3 is a side view of the M.U.L.S.A. after pivoting the support plate upward to provide support for the top of a ladder from a vertical wall.

Also as shown particularly in FIGS. 3 and 6, a pair of upper arm extenders 112, containing a plurality of apertures 113, are pivotally attached at one end to a pair of angle brackets 123, using bolts 124 and wingnuts 125 or other means. The angle brackets 123 are adjustably attached to the support plate assembly 120 (comprising a soft plate pad 121, a metal base plate 122 and angle brackets 123) such that the distance between the angle brackets 123 can be changed to accommodate ladders of different widths, for example, by selecting the appropriate apertures 126 to attach the angle brackets 123 to (the brackets 123 are secured to the base plate 122 by screws 127).

The other ends of the extenders 112 are inserted into the outer ends of the upper arm spokes 111 and provide an extensible and retractable, telescoping, sliding action of the upper arm assembly 110. The extenders 112 are held in a selected position inside the spokes 111 by using a locking device 180 such as shown in FIGS. 7*a* and 7*b* (or other means such as a bolt and nut etc.)

Figure 7A:
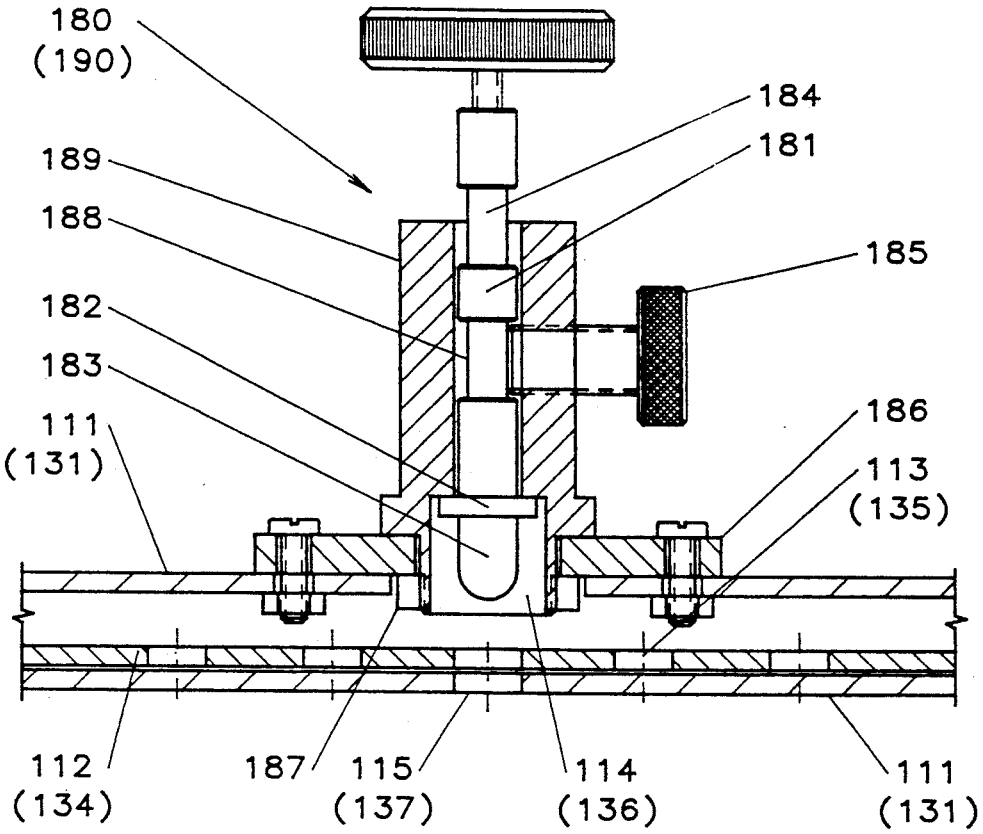
FIG. 7A is a section view based on cutting plane A—A of FIG. 6 showing the unlocked position of the locking device used to hold adjustable assemblies together. (lower arm numerals are in parenthesis).
Figure 7B:
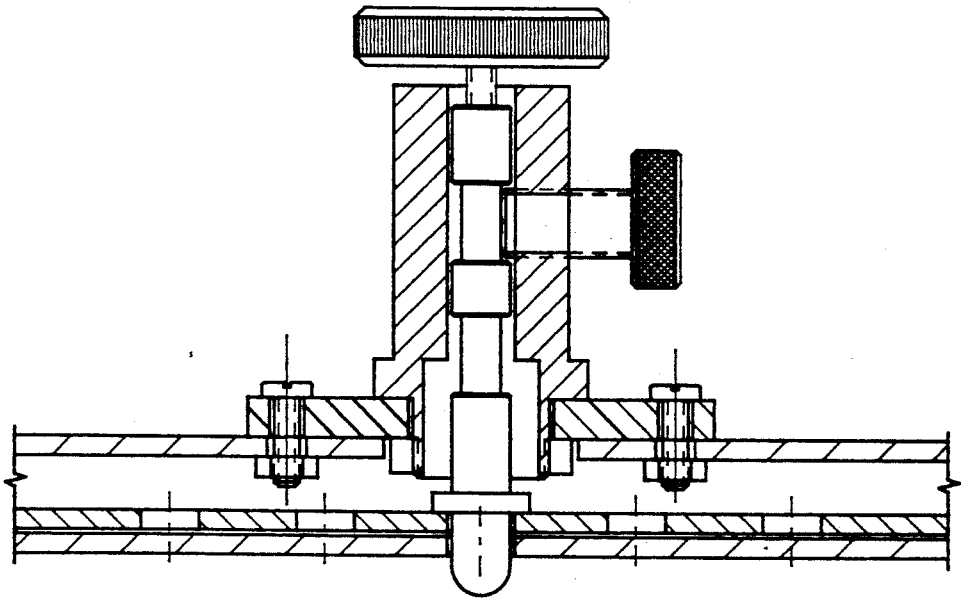
FIG. 7B is a view as in FIG. 7A of the locked position.
Figure 13:
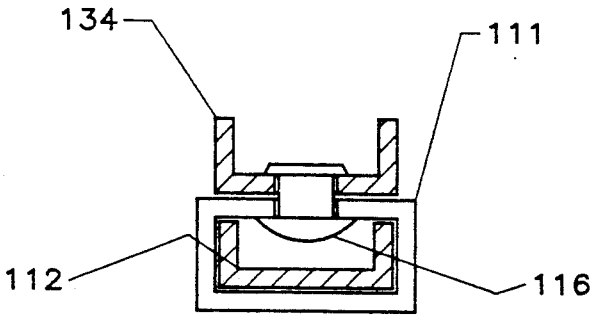
FIG. 13 is a section view taken on cutting plane B—B of FIG. 3 showing attachment of upper arm to lower arm.

As shown in FIGS. 7*a* and 7*b*, the locking device plunger 181 is inserted thru the outer aperture 114 of the upper arm spoke 111, then thru a selected aperture 113 of the upper arm extender 112 and then thru the inner aperture 115 of the upper arm spoke 111. As shown in FIG. 7*b*, with the selected apertures 113 properly aligned and the thumb screws 185 backed out of slots 188 to permit the plungers 181 to be pushed in, the collar 182 holds each upper arm extender 112 tightly against each upper arm spoke 111. The plunger tips 183 protrude thru apertures 115. Tightening the thumb screws 185 into slots 184 provides a secure lock of the extenders 112 to the spokes 111. The aperture 113 selected will determine the distance the upper arm assembly 110 extends between the ladder rails 16 and the support plate assembly 120. The upper arm assembly 110 (consisting of the upper arm spoke 111, the upper arm extender 112, the support plate assembly 120 and the locking device 180) is pivotally connected to one end of the lower arm extender 134 of the lower arm assembly 130 by a rivet 116 or other suitable means, as best shown in FIGS. 3 and 13. The extender 134 contains a plurality of apertures 135; it slides inside its lower arm spoke 131. The lower arm spokes 131 are offset by bracket 132 and pivotally attached to each end of an adjustable length threaded rod 151 of an assembly like that involving rod 141 in FIGS. 12 and 12*a* centered within the next lower rung 14 and secured by wingnuts 152. The lower arm extender 134 is selectively locked to the lower arm spoke 131 using locking device 190 in the same way as the upper arm extender is locked into the upper arm spoke (see FIGS. 7*a* and 7*b*), device 190 being a duplicate of device 180. The position of the lower arm extender 134 inside the lower arm spoke 131 determines the angle of the upper arm assembly 110 with respect to the ladder rails 16.

The extender apertures 135 are properly positioned and spaced to allow the extender 134 to be attached to the lower arm spoke 131 so that the ladder 10 can be supported as shown in FIG. 2. By selecting a particular different aperture 135, the ladder 10 can be supported against and offset from a vertical wall, as shown in FIG. 3. By selecting any of the available apertures 135 between these two, the ladder 10 can be supported on any slope (pitch) roof from flat to nearly vertical as illustrated in FIG. 5.

Adjustment to these different positions is done by loosening the upper arm wingnuts 143 (FIGS. 6 and 12) and the lower arm wingnuts 152 and unlocking the upper arm and lower arm locking devices 180 (FIG. 7*a*) and 190. The upper arm assembly 110 and lower arm assembly 130 is each then free to move and can be pivoted to any support position shown on FIG. 5, from position 1 to position 7. Tightening the wingnuts 143 and 152 and locking the locking devices 180 and 190 in a selected position will provide a rigid and secure support structure in any selected position. Because of the offset provided by bracket 132, the extender 134 can move past the pivoting location where spoke 131 is attached to the ladder, without interfering with the pivot. The offset provided by bracket 132 and also the slotting provided by the u-cross sectional shape of the lower arm spoke 131 (which permits rivet 116 to move into spoke 131) contribute to the immensely variable positioning capability demonstrated in FIG. 5.

Figure 4:
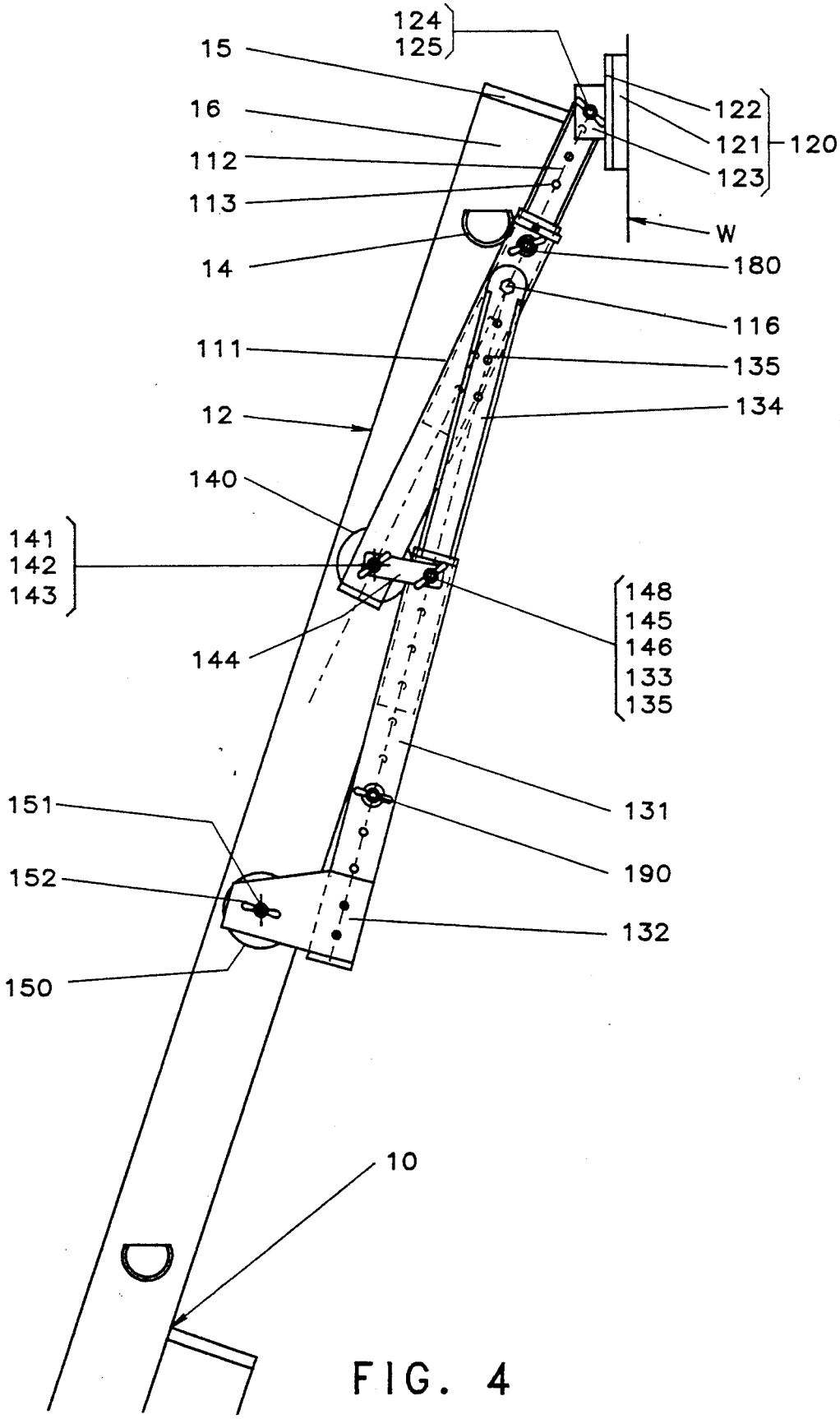
FIG. 4 is a side view of the M.U.L.S.A. after pivoting further upwards and showing the support plate positioned between the ladder tops and a vertical wall.
Figure 5:
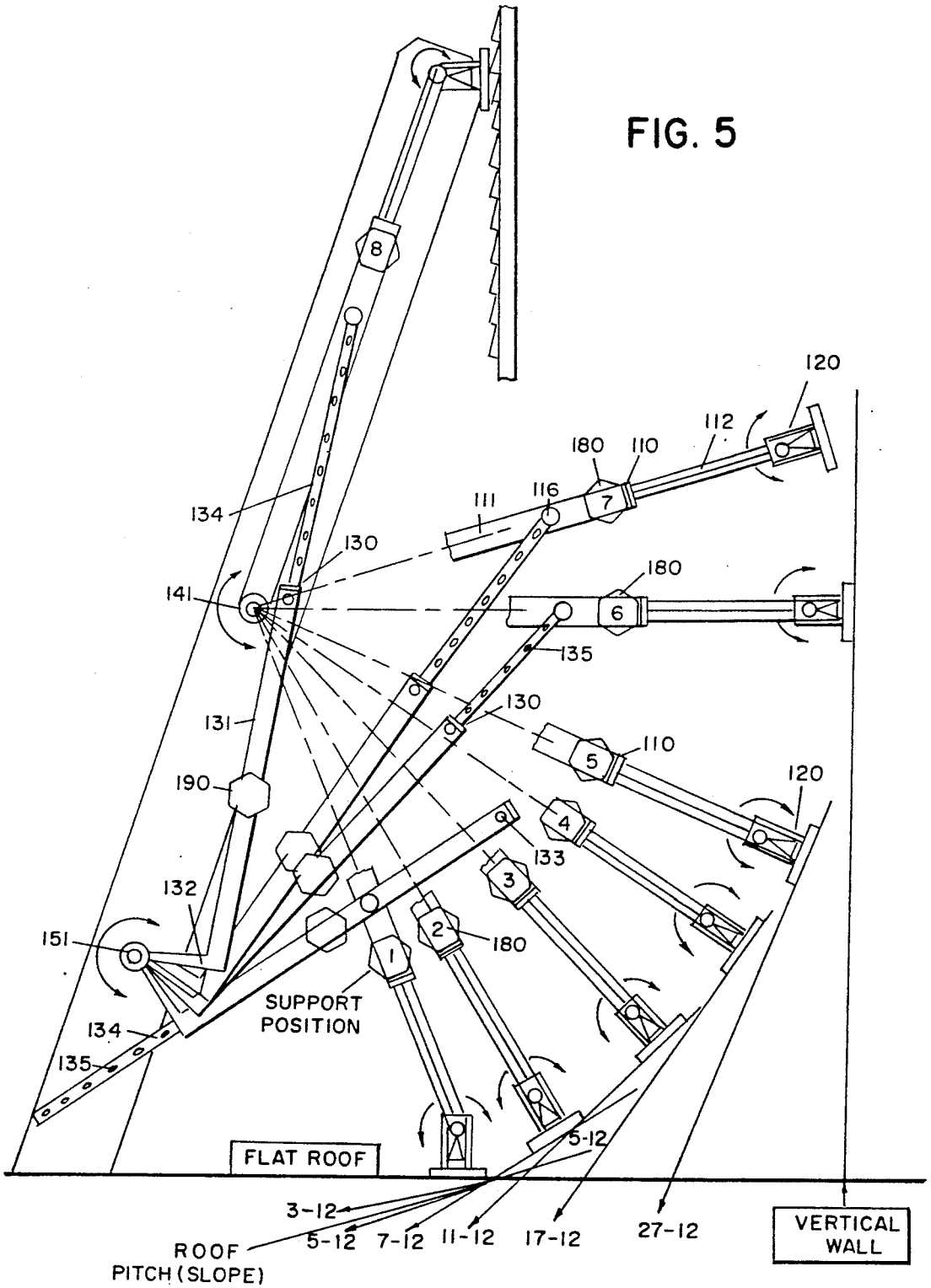
FIG. 5 is a combination side view showing the M.U.L.S.A. supporting the ladder top from several differently sloped roofs, a vertical wall and as used as a buffer plate between siding and rail tops.

To move to the storage, transport and support position 8 of FIG. 5, and thus to the position illustrated in FIG. 4, the wingnuts 143 and 152 (FIG. 6) are loosened and the lower locking device 190 is unlocked. The upper arm assembly 110 is pulled up into position as shown in FIGS. 4 and 5 (position 8). This causes the lower arm spokes 131 to pivot upward and the extenders 134 to extend out to their maximum extension, where they cannot be secured by locking device 190. In this position of the extender 134, the storage bolt 145 (FIGS. 3 and 12) is inserted thru the outer aperture 148 of the storage bracket 144 (which is spaced in position by clearance spacer 142), then thru aperture 133 of the lower arm spoke 131, then thru aperture 135 of the lower arm extender 134, then out the other side of the lower arm spoke 131, where it is secured by the storage wingnut 146. The wingnuts 143 and 152 are then tightened and the M.U.L.S.A. 100 is securely attached in storage position to the ladder 10. In this storage position, the ladder can be used essentially as a normal ladder with the added benefit of the support plate assembly 120 acting as a buffer between the ladders rail tops 15 and fragile house siding to protect the siding from damage caused by the top of the ladder. This position also provides additional frictional contact between the support plate assembly and a wall surface and is used for storage and transporting. Adjustment of the position of assembly 120 may be done via locking device 180 to assure that it is at the top of the ladder. Adjustment of wingnuts 125 permit pad 121 of assembly 120 to be adjusted to be flat against a vertical wall.

The adjustable length threaded rods 141 and 151 (FIGS. 12 and 12*a*), that are used to hold the upper and lower arm assemblies in place, will also allow for the tightening and loosening of these arm assemblies by turning only one wingnut 143 (or knob) at the upper arm and one wingnut 152 (knob) at the lower arm. This is accomplished because the upper arm spoke 111 (FIG. 12) is tightened against spacer/collar 140 at each end of the upper rung 14 when threaded rod 156 is screwed into hollow tube 155 (containing threads 158 at one end and a threaded stud 157 affixed to the other end). A wingnut 143 (or knob) locked to one end of threaded rod 156 is used to turn rod 156 in or out of hollow tube 155. The threaded stud 157 is locked to one upper arm spoke 111 using pin 159 or other method. This insures that stud 157 and tube 155 can not rotate. When rod 156 is screwed into tube 155, both upper arm spokes 111 are simultaneously tightened (sandwiched) against spacer/-collar 140 and the ladders rails 16. Loosening rod 156 loosens both upper arm spokes 111 and allows them to be moved freely (when lower arm extender 134 is unlocked from lower arm spoke 131). This same action can be repeated at the lower rung to allow both lower arm spokes 131 to be tightened and loosened simultaneously using one wingnut 152 (or knob).

Figure 9:
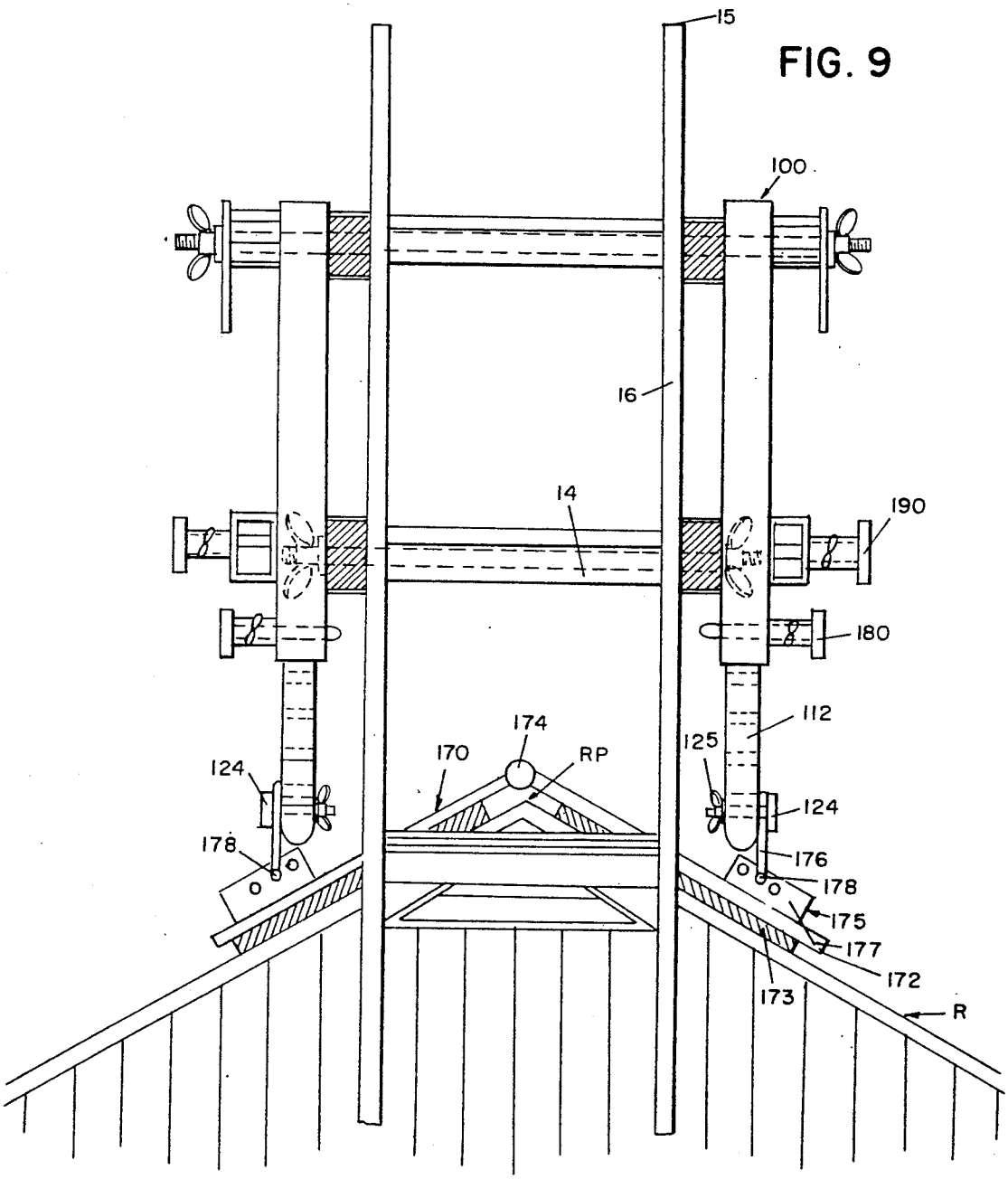
FIG. 9 is a front view of the M.U.L.S.A. supporting a ladder top over and away from the peak of a roof at the gable end of a house.

Referring now to FIGS. 8*a*, 8*b*, and 9, by substituting an optional combination support plate assembly 170 for the standard support plate assembly 120, all the previously described support positions can be achieved, as described, by simply allowing the soft plate 171 (corresponding to pad 121) to remain attached to the optional combination support plate assembly 170. The soft plate 171 may be made of wood or some other relatively soft sturdy material, and by remaining attached to the hinged split metal plate 172, no hinge (pivoting) action can take place. Removing the assembly bolts 128 and the soft plate 171 from the optional plate assembly 170 will allow the remaining split metal plate 172 (with soft pads 173 attached) to pivot on a hinge 174 and be placed in a generally inverted "V" shape. A support plate of this shape, when attached to the M.U.L.S.A., can be used to support the top of a ladder over and away from the peak of a roof RP at the gable ends of a house.

A dual swivel bracket assembly 175 (consisting basically of a channel bracket 177, a connecting mounting plate 176 and swivel pin 178 attached to plate 176) is pivotally attached at the connecting mounting plate 176 end to each extender 112 using a bolt 124 and nut 125. This will allow the split metal plate, when attached, to rotate about an axis parallel to the ladder rungs by pivoting on bolt 124. At the same time, the channel bracket 177 is free to rotate about a horizontal axis by pivoting on the swivel pin 178 which is perpendicular to the ladder rungs.

The channel bracket 177 will be selectively mounted to the split metal plate 172 using selected apertures 179 and mounting bolts 127. For example, with the extenders 112 in place on the ladder and attached to the connecting mounting plate 176, the center of the split metal plate 172 is lifted to produce an inverted V shape that duplicates the roof peak RP angle. Then the channel brackets 177 are attached to the split metal plate 172 using mounting bolts 127 and selected apertures 179 which will align with corresponding apertures on the split metal plate 172. The M.U.L.S.A. 100 is now configured to support a ladder top from the peak of a roof. Tightening the wingnuts 143 and 152 and locking the locking devices 180 and 190, where required, will provide a stable support for the ladder.

Figure 10:
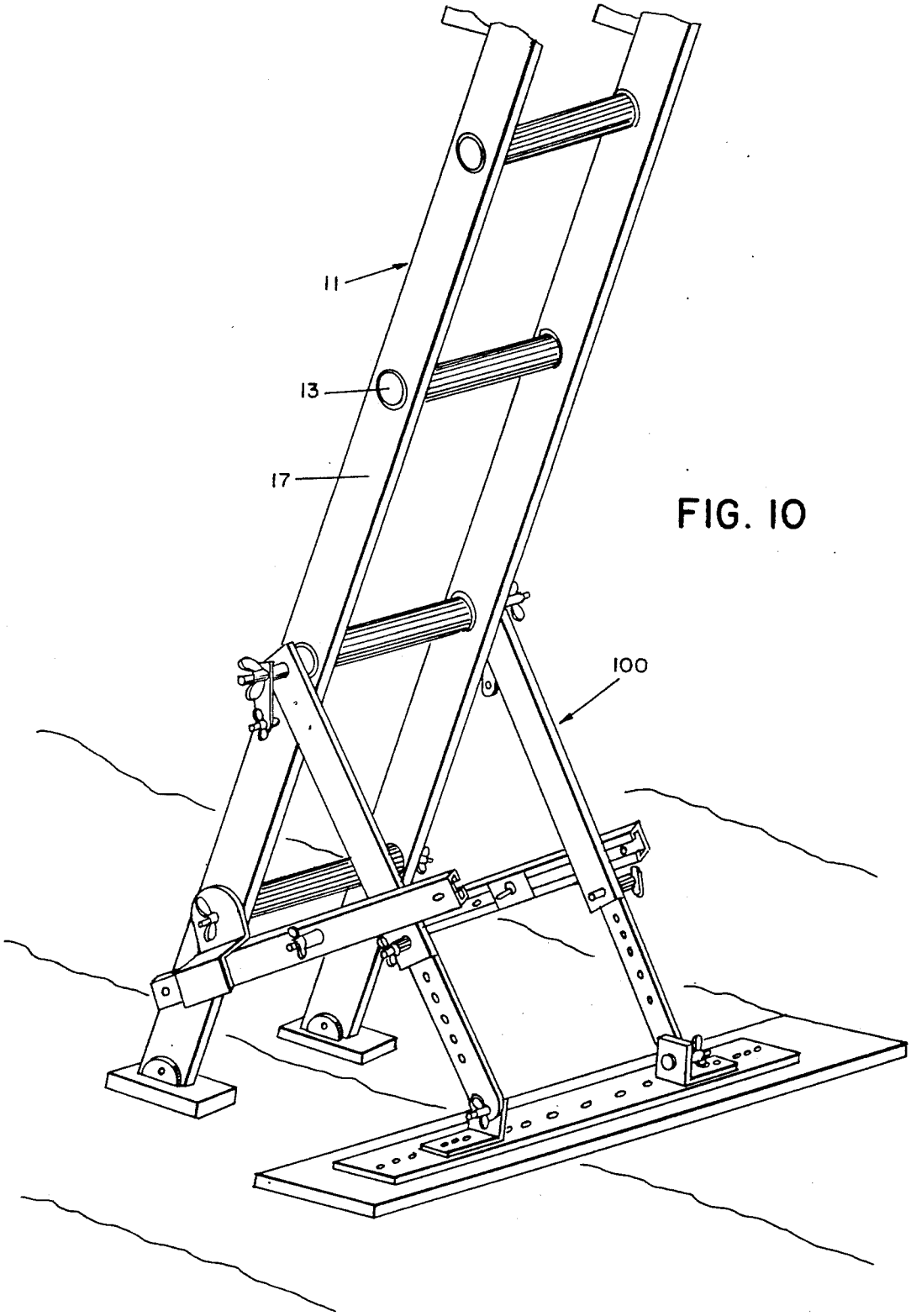
FIG. 10 is a perspective view of the M.U.L.S.A. attached to the bottom of a ladder and using the ground as the base for support.
Figure 11:
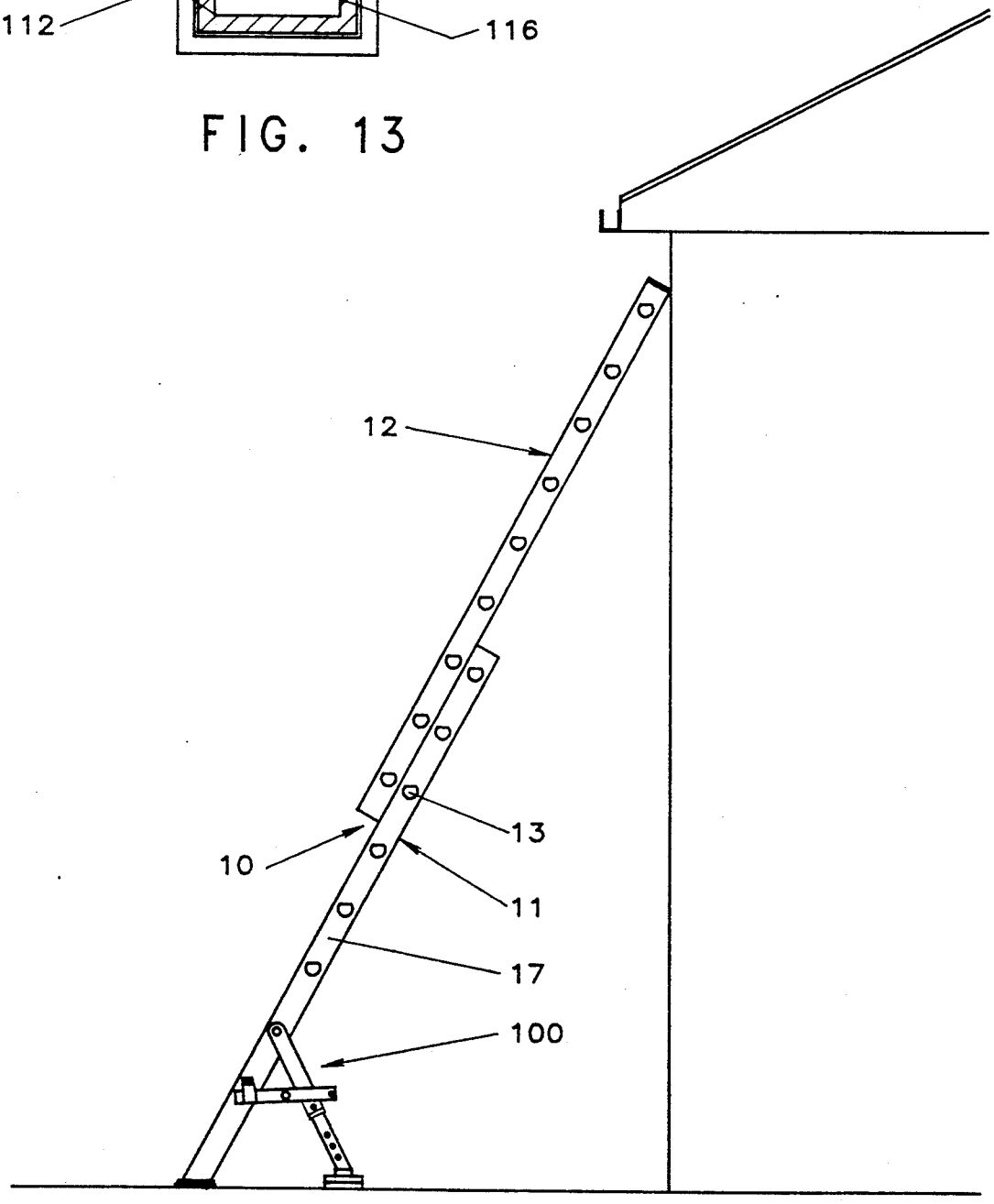
FIG. 11 is a side elevation of the M.U.L.S.A. shown attached to the base of a ladder for base stability.

With the M.U.L.S.A. 100 attached to the bottom two rungs 13 of a hollow rung ladder 10 as shown in FIGS. 10 and 11, a significant increase in ladder base stability will result. The M.U.L.S.A. is attached to these bottom rungs in the same manner it is attached at the top of the ladder.

Figure 14:
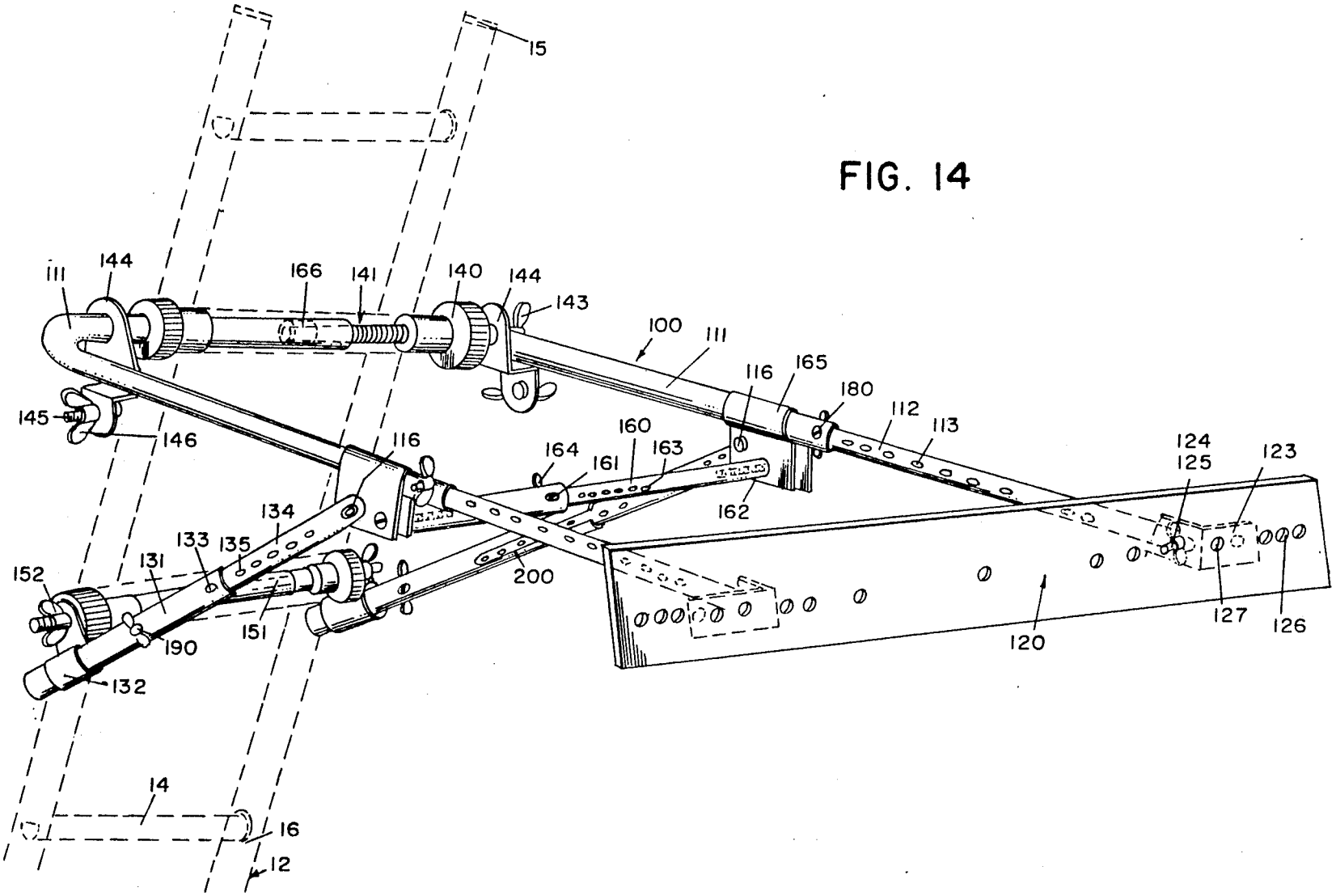
FIG. 14 is a perspective view of M.U.L.S.A. variation which uses round tubular material.

A variation of the M.U.L.S.A. 100 is shown in FIG. 14 wherein the device is constructed using round tubing in place of rectangular tubing. The functions performed are the same as previously described but some of the attachment methods are different. An upper arm clamp 165 is used to connect each upper arm spoke 111 to each lower arm extender 134 using rivet 116 or other means such as a bolt and nut. The telescoping tubular cross-brace 160 is also attached at each end to the upper arm clamp 165 using screw 162. One of the hollow upper arm spokes 111 is bent at the ladder rung 14 and, with a threaded insert 166 installed, is used as part of the adjustable length threaded rod 141. The other spoke 111 is laterally drilled to permit the free end of threaded rod 141 to extend thru for securement by wingnut 143. This is essentially the same as for the adjustable length threaded rod 141 shown in FIG. 12 and 12A. The storage bracket 144 is shaped to allow for being installed between the upper arm spoke 111 and the rung spacer 140 and performs as previously described. Bolts and nuts are used as simplified locking devices 180 and 190, in place of the multifunctional embodiment shown in FIGS. 7A and 7B. In the embodiment also, an offset bracket 132 and slotting 200 provide an equivalent flexibility of positioning to that demonstrated in FIG. 5 for the first embodiment of this invention.

I claim the following:

1. A ladder support attachment comprising adjustable upper arm means for pivotal connection at one end to an upper rung of a ladder, support means for pivotal connection to an opposite end of the upper arm means, adjustable length lower arm means for pivotal connection at one end to a lower rung of a ladder and at an opposite end to the upper arm means, the adjustability and interconnection of the three means being such that a ladder may be supported with the support means alternatively in contact with ground or floor or building surfaces ranging from a flat roof to a vertical wall, the arm means including an offset means permitting telescoping movement past a pivot.

2. An attachment as claimed in claim 1, the upper and lower arm means including means for pivotally connecting the arm means about axes internal to ladder rungs.

3. An attachment as claimed in claim 1, wherein the upper arm means controls distance to the support means and the lower arm means controls the angle relationship of the upper arm means to a ladder.

4. An attachment as claimed in claim 1, the support means permitting undamaging support against foam filled sheathing.

5. An attachment as claimed in claim 1, the adjustability and interconnection of the three means permitting support of a ladder on a roof over and away from gutter and eaves of a roof.

6. An attachment as claimed in claim 1, the arm means being telescoping and containing locking and unlocking means for permitting adjustment of length.

7. An attachment as claimed in claim 1, the offset means comprising a bracket offsetting the lower arm means from the lower rung.

8. A ladder support attachment comprising adjustable upper arm means for pivotal connection at one end to an upper rung of a ladder, support means for pivotal connection to an opposite end of the upper arm means, adjustable length lower arm means for pivotal connection at one end to a lower rung of a ladder and at an opposite end to the upper arm means, the adjustability and interconnection of the three means being such that a ladder may be supported with the support means alternatively in contact with ground or floor or building surfaces ranging from a flat roof to a vertical wall, the support means including gable support means for supporting from the intersecting slopes of a peak of a roof at a gable end.

9. An attachment as claimed in claim 8, the gable support means being hinged and adjustably connected to the upper arm means to permit the gable support means to lie against the intersecting slopes.

10. A ladder support attachment comprising adjustable upper arm means for pivotal connection at one end to an upper rung of a ladder, support means for pivotal connection to an opposite end of the upper arm means, adjustable length lower arm means for pivotal connection at one end to a lower rung of a ladder and at an opposite end to the upper arm means, the adjustability and interconnection of the three means being such that a ladder may be supported with the support means alternatively in contact with ground or floor or building surfaces ranging from a flat roof to a vertical wall, the adjustability and interconnection of the arm means being such that the upper arm means may be at right angles to a building surface at all slopes equal to or greater than 3–12.

11. A ladder support attachment comprising adjustable upper arm means for pivotal connection at one end to an upper rung of a ladder, support means for pivotal connection to an opposite end of the upper arm means, adjustable length lower arm means for pivotal connection at one end to a lower rung of a ladder and at an opposite end to the upper arm means, the adjustability and interconnection of the three means being such that a ladder may be supported with the support means alternatively in contact with ground or floor or building surfaces ranging from a flat roof to a vertical wall, the adjustability and interconnection of the arm means being such that the arms may be brought into a storage position wherein the arm means are essentially parallel to a ladder and wherein the support means may support a ladder against a wall of a building.

12. An attachment as claimed in claim 11, further including means (144) for locking the arm means in the storage position.

13. A ladder support attachment comprising upper arm spokes, lower arm spokes, rod means for internal passage through ladder rungs for pivotal connection of the spokes respectively to upper and lower rungs of a ladder, upper arm extenders telescoped with the upper arm spokes, lower arm extenders telescoped with the lower arm spokes, the lower arm extenders being pivotally connected at one end to the upper arm spokes, and a support pad means connected to the upper arm extenders for providing support against a surface.

14. An attachment as claimed in claim 13, the lower arm spokes each having a bracket for providing offset of it's pivotal connection to the lower rung, such that the lower arm extenders may telescope past the lower rung.

15. An attachment as claimed in claim 13, further comprising means for locking the arms in an essentially ladder-parallel position in which the support pad may guard a building wall from the upper end of a ladder.

16. An attachment as claimed in claim 13, the support pad means being hinged and adjustably connected to the upper arm extenders to accommodate the intersecting slopes of a roof peak.

17. A ladder support attachment comprising a first arm means for extending between a ladder and a surface and a second, telescoping arm means for extending between the first arm means and the ladder, the second arm means having a location for pivotal connection to the ladder, the second arm means telescoping along an axis offset to clear said location, such that telescoping action may be carried out past said location without interference therewith.

18. A ladder support attachment comprising first and second arm means for mounting on a ladder and being selectively lockable into triangular ladder supporting configurations and collapsible into a generally ladder-parallel storage configuration, further comprising a means (144) for locking the arm means into the storage configuration.

19. A ladder support attachment comprising first and second arm means for mounting on a ladder and being selectively lockable into triangular ladder supporting configurations and collapsible into a generally ladder-parallel storage configuration, further comprising means on the arm means for cushioning the weight of a ladder from a wall in the storage configuration of the arm means.

20. A ladder support attachment comprising two arm means for extending from two rails of a ladder for spacing a ladder from a building and an inverted V-shaped support means on the arm means for securing support from a roof peak, said support means comprising two V-legs joined together at a V-point, the V-legs extending inwardly from the arm means to the V-point between the arm means.

21. A ladder support attachment comprising a first arm means for extending between a ladder and a surface and a second, telescoping arm means for extending between a pinned connection to the first arm means and the ladder, the second arm means being slotted to permit the pinned connection to move into the second arm means.

22. A ladder support attachment comprising a telescoping arm and a locking plunger means for selectively locking telescoping arm parts tightly together laterally, tightly against one another.

23. A ladder support attachment for a hollow rung ladder comprising two arms, an elongate means for extending through a rung, a means (159) for interlocking one of the arms to one end of the elongate means, the other arm being insertable onto an opposite end of the elongate means, and a threaded means (143) on said opposite end, whereby the arms may be drawn toward both sides of the ladder or released by turning of the threaded means.

* * * * *